US008026796B2

(12) United States Patent
Kiran

(10) Patent No.: US 8,026,796 B2
(45) Date of Patent: Sep. 27, 2011

(54) WARNING SYSTEM FOR TIMELY ADMINISTRATION OF DRUGS THAT HAVE TO BE ADMINISTERED AT CERTAIN TIMES

(76) Inventor: Kazim Kiran, Istanbul (TR)

( * ) Notice: Subject to any disclaimer, the term of this patent is extended or adjusted under 35 U.S.C. 154(b) by 151 days.

(21) Appl. No.: 12/301,768

(22) PCT Filed: Apr. 19, 2007

(86) PCT No.: PCT/IB2007/051429

§ 371 (c)(1),
(2), (4) Date: Nov. 20, 2008

(87) PCT Pub. No.: WO2007/135578

PCT Pub. Date: Nov. 29, 2007

(65) Prior Publication Data

US 2009/0284355 A1 Nov. 19, 2009

(30) Foreign Application Priority Data

May 22, 2006 (TR) ..... U 2006 02500

(51) Int. Cl.
*G08B 1/00* (2006.01)

(52) U.S. Cl. ..... 340/309.16

(58) Field of Classification Search ..... 340/309.16, 340/573.1, 526, 502; 368/10
See application file for complete search history.

(56) References Cited

U.S. PATENT DOCUMENTS

| | | | | |
|---|---|---|---|---|
| 4,419,016 | A * | 12/1983 | Zoltan | 368/10 |
| 4,939,705 | A * | 7/1990 | Hamilton et al. | 368/10 |
| 5,751,661 | A * | 5/1998 | Walters | 368/10 |
| 6,317,390 | B1 * | 11/2001 | Cardoza | 368/10 |
| 6,529,446 | B1 * | 3/2003 | de la Huerga | 368/10 |
| 6,667,936 | B1 * | 12/2003 | Ditzig | 368/10 |
| 6,710,703 | B2 * | 3/2004 | Huang | 340/309.16 |
| 6,845,064 | B2 * | 1/2005 | Hildebrandt | 368/10 |
| 2005/0117455 | A1 * | 6/2005 | Valerio | 368/10 |
| 2005/0151625 | A1 | 7/2005 | Lai | |
| 2006/0220818 | A1 | 10/2006 | Trochesset | |

FOREIGN PATENT DOCUMENTS

| | | | |
|---|---|---|---|
| WO | WO/99/66373 | A | 6/1999 |
| WO | WO/2004/108476 | A | 12/2004 |

* cited by examiner

*Primary Examiner* — Phung Nguyen
(74) *Attorney, Agent, or Firm* — Venable, Campillo, Logan and Meaney PC

(57) ABSTRACT

The present invention relates to a system which reminds the user of the time at which they must take their medication through the use of an alarm using light and sound which, thanks to an apparatus that is activated at the initial opening of the cap (2) of the medicine bottle (10) and which is positioned on the medicine bottle's (10) cap (2) allows the user to administer drugs which can only be effective when taken at the right time. The system can be set in advance in accordance with the time intervals, drug types and the amount of drugs associated with the drugs in the medicine bottle (10). The system provides alerts for patients who may be blind or deaf by using a warning which utilizes both light and sound.

12 Claims, 4 Drawing Sheets

WARNING SYSTEM FOR TIMELY ADMINISTRATION OF DRUGS THAT HAVE TO BE ADMINISTERED AT CERTAIN TIMES

TECHNICAL FIELD

The present invention relates to a system which reminds the user of the time at which they must take their medication through the use of an alarm using light and sound which, thanks to an apparatus that is activated at the initial opening of the cap (2) of the medicine bottle (10) and which is positioned on the medicine bottle's (10) cap (2) allows the user to administer drugs which can only be effective when taken at the right time.

PRIOR ART

Many studies done today suggest that the medicines used in the treatment of illnesses are more apt to be effective only when used at certain time intervals. However, the administering of medication at the correct time requires a lot of care attention, and patients/users, despite being very careful constantly neglect to take their medication and usually postpone it to a later time. The medication therefore is no longer as beneficial as it would have been, while the patient reaps only a part of the benefit of the drug. This prolongs the treatment period. With the present invention the users are alerted by an alarm using light and sound to the time when the drugs must be administered. The timely administering of the drug is further made possible by the alarm's repetitiveness. The system which is the subject of this invention does away completely with this problem. There is no equal on the market with which to compare it.

The system aims to alert patients who may be blind or deaf by using a warning which utilizes both light and sound.

The invention informs the user of the time of drug administration through a mechanism positioned in the packaging in the cap (2) of the medicine bottle (10).

The system comprises an integrated light and sound circuit (6) with a timer which is able to give out a warning in accordance with the specific time intervals at which the drug contained in the bottle (10) has to be taken and the medicine bottle (10) can furthermore be calibrated depending on the type of drug and the amount of drug in the bottle. The said light and sound warning repeats itself until the user opens the cap (2) of the medicine bottle (10).

The present invention concerns a system placed in the cap of drugs that have to be taken at certain intervals and was developed to remind the user with a warning that uses light and sound.

Furthermore, with its adjustable warning system, the drug is also suited for drug packages other than bottles, such as box-like drug packages. Moreover, it is also a suited system for food products which must be consumed within a certain time frame after opening or similar products that may have placed in them a system where at preset times, especially to warn users of the impending expiry date, an alarm using light and sound could be of use.

BRIEF DESCRIPTION OF THE FIGURES

The system realized to fulfill the object of the invention is illustrated in the appended Figures, wherein.

LIST OF PARTS

Figure 1:
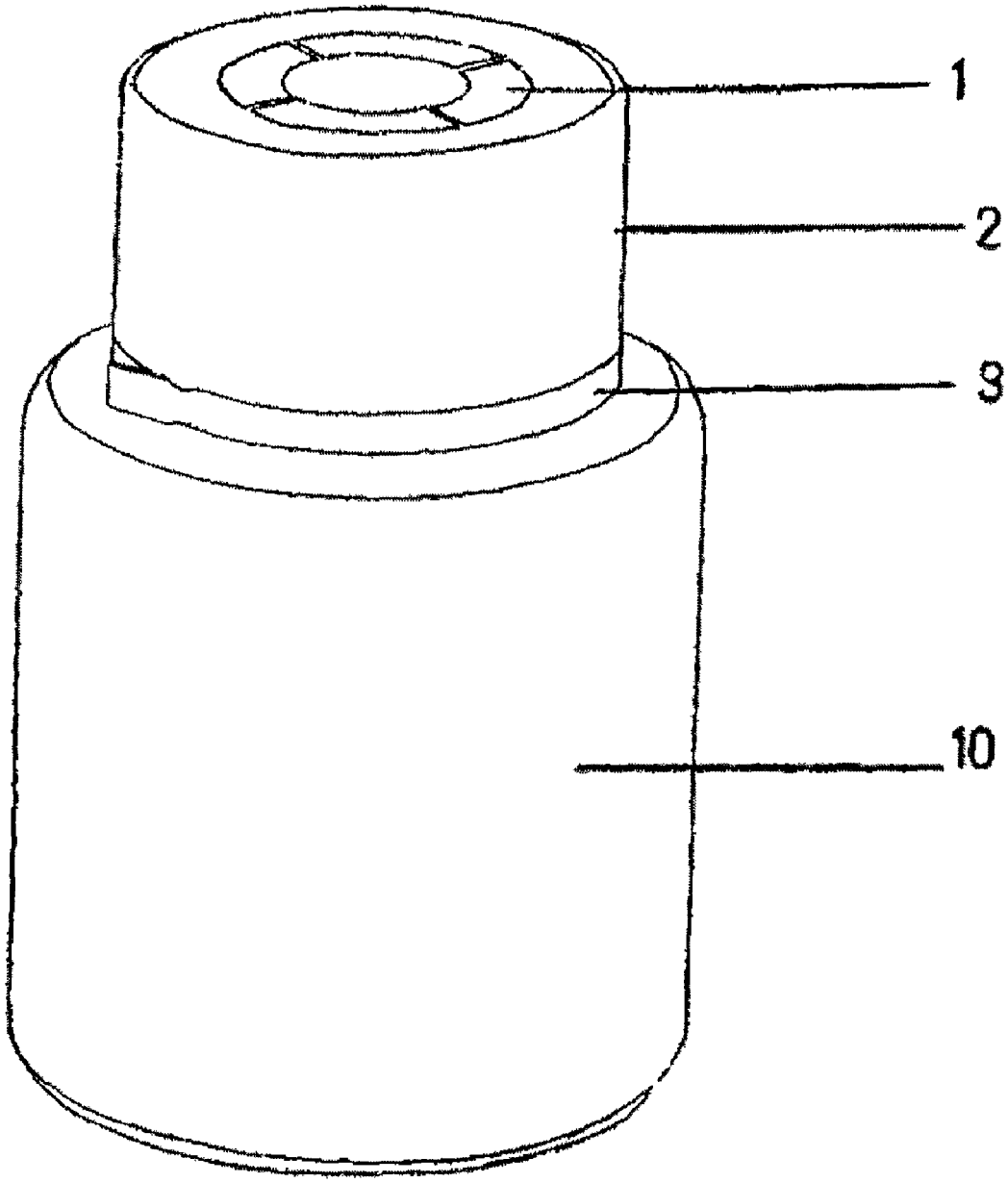
FIG. 1—is a perspective view of the medicine bottle (10) on which the invention is positioned.
Figure 2:
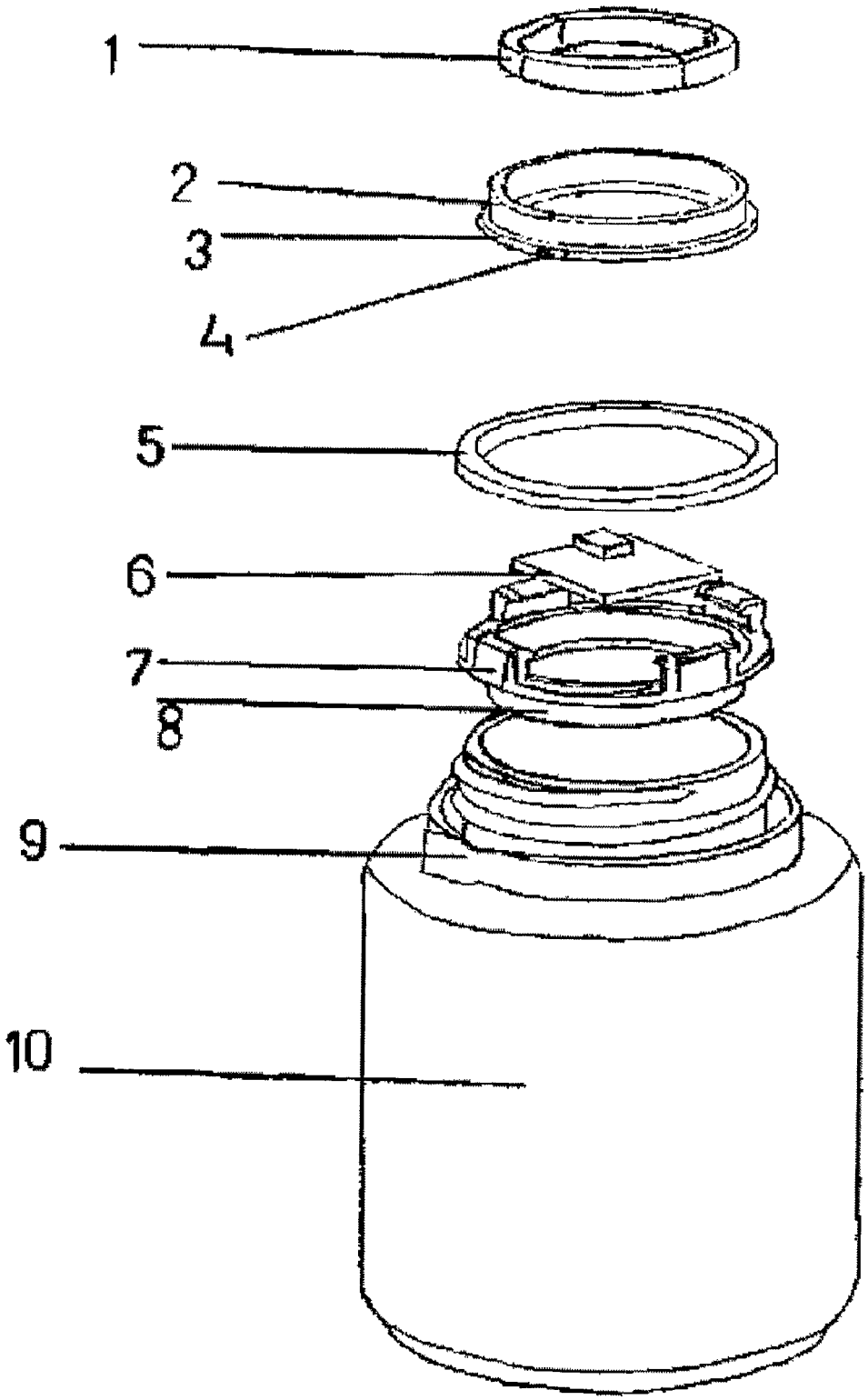
FIG. 2—is a detailed perspective view of the parts (1, 2, 3, 4, 5, 6, 7, 8, 9, 10) comprising the invention.
Figure 3:
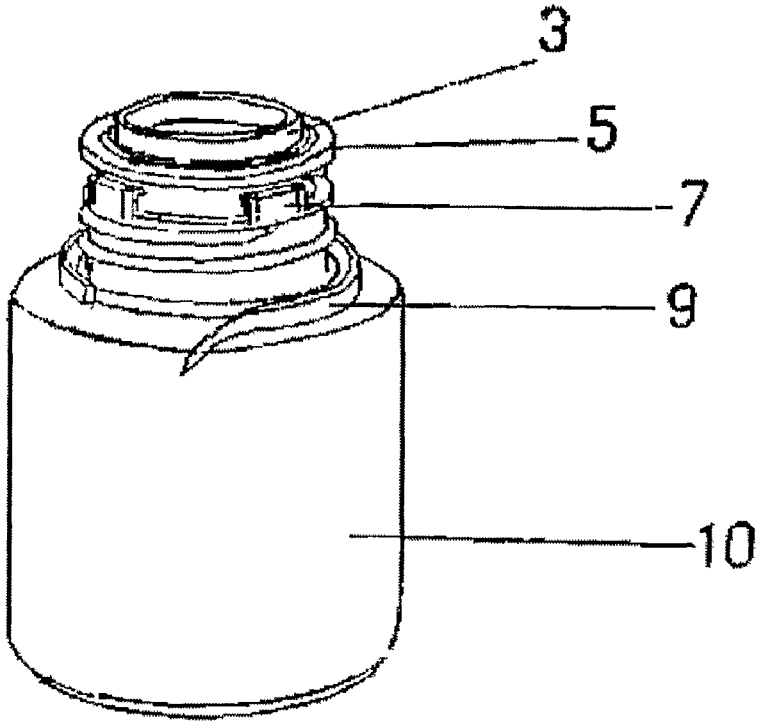
FIG. 3—is a view of the safety band (9) as when extracted from between the medicine bottle (10) and the cap (2) on which the invention is positioned.
Figure 4:
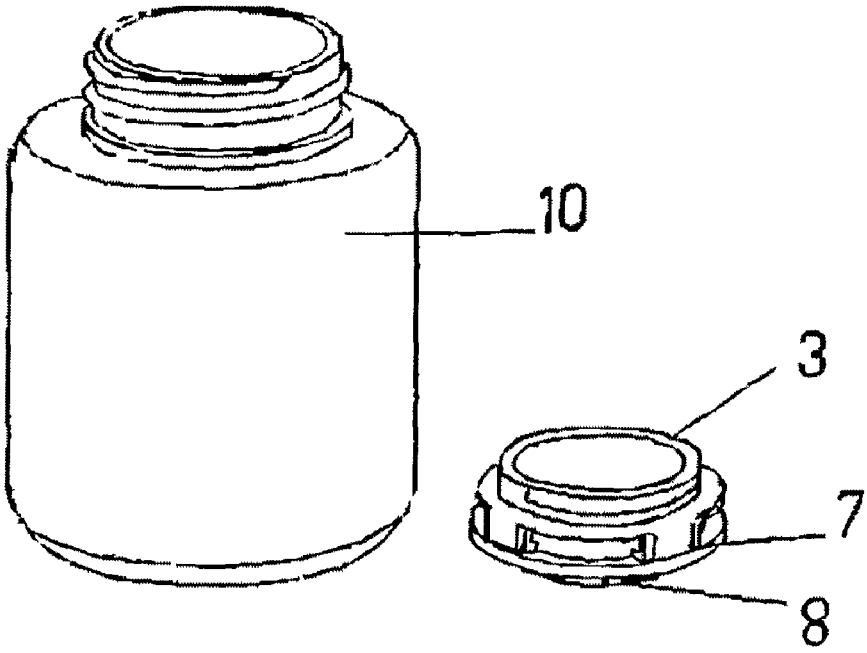
FIG. 4—is a view of cap (2) and the medicine bottle (10) on which the invention is positioned when they are separated.
Figure 5:
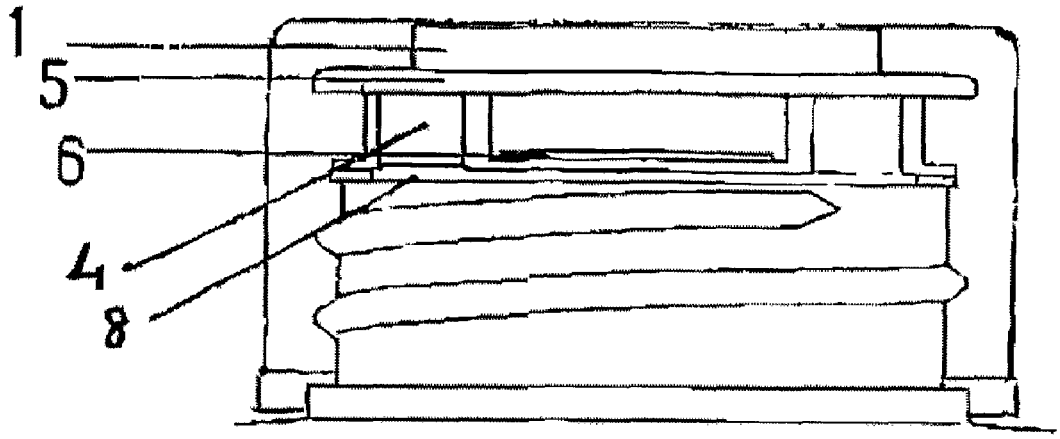
FIG. 5—is an isometric section view of the parts when the alarm is activated during contact between the electric copper switch (8) on the inner cap (7) and the copper electric switch (4) positioned in lower part of the safety ring (3) as the cap is screwed on in clockwise direction.
Figure 6:
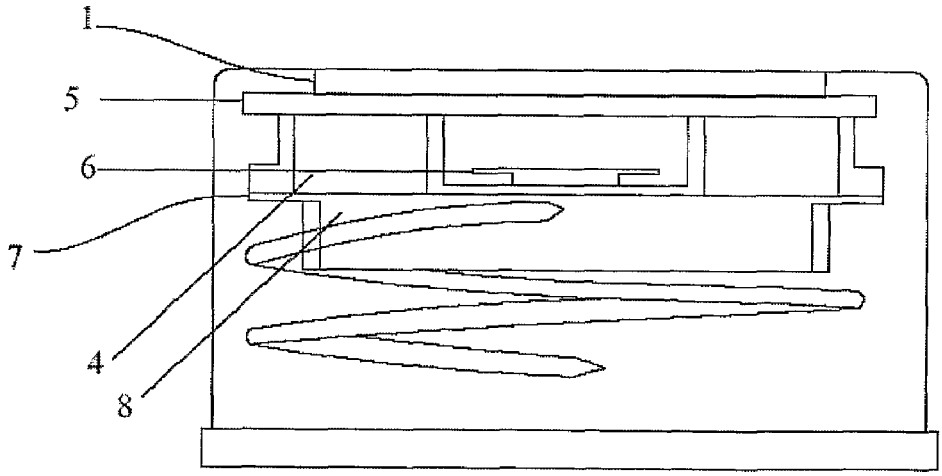
FIG. 6—is an isometric section view of the parts when the system within the cap (2) continues to function without the bottle (10) through contact between the electric copper switch (8) positioned in the inner cap (7) and the electric copper switch positioned (4) in the lower part of the safety ring (3) by way of the rubber stopper (5), previously pressured by the cap, which expands when the cap is opened.

The parts are also numbered and their references are indicated below.

1—Translucent plastic, produced especially to convey light (1)
2—Cap (2)
3—Safety Ring (3)
4—The electric copper switch positioned at the lower part of the safety ring (4)
5—The round rubber stopper positioned around the safety ring (5)
6—Integrated sound and light circuit having a timer (6)
7—Inner cap (7)
8—Electric copper switch positioned on the inner cap (8)
9—Safety band (9)
10—Medicine bottle (10)

The Function of the Mechanism and the System

The system found in the cap (2) of the medicine bottle containing the drugs; is a system that aims to alerts the user via sound and light about when the drugs are to be administered.

Among the parts comprising the system; the specially made translucent plastic (1) comprises four equidistant slots in order to fit into the cap (2). A part in the top middle section of the cap is visible when the bottle is shut. This part is made of a translucent material. As the alarm is activated, this allows the light projection to be increased, thereby enabling the user to see it more easily.

The integrated sound and light circuit (6) found in the system can be set in advance in accordance with the time intervals, drug types and the amount of drugs associated with the drugs in the medicine bottle (10).

The electricity needed to power the system is provided by the integrated sound and light circuit having a timer (6). From when the system is activated at the point of screwing on the cap (2); the electrical energy needed for sound and light alarm necessary for the amount and type of drugs in the medicine bottle (10) is provided by the sound and light circuit having a timer (6).

The rubber stopper (5) positioned around the safety ring in the system is made of a flexible material. When the inner cap (7) is closed it is compressed to make it less thick, and expands when the cap is opened. Thus it enables the system to function even when the cap (2) is opened and is separate from the medicine bottle (10).

During the functioning of the system of the present invention, the safety ring (3) is joined to the inner cap (7) with a vertical motion. Positioned inside the inner cap is an integrated sound and light circuit having a timer (6). This integrated sound and light circuit having a timer (6) is connected to the electric copper switch (8) found inside the inner cap.

Prior to the initial use of the system the safety band (9) is joined to the cap (2). After the safety band (9) is opened the cap (2) is screwed onto the medicine bottle in a clockwise manner with all its contained parts. The inner cap (7), along with the integrated sound and light circuit having a timer (6) and the electric copper switch (8) positioned on the inner cap (7) are pushed upwards by the medicine bottle (10) which is then able to fit into the cap (2) along with the safety ring (3). Thus, the electric copper switch (4) positioned below the safety ring (3) and the electric copper switch (8) positioned on the inner lid are able to make contact and get the system to function.

The Functioning of the System

The invention is positioned in the cap (2) of the medicine bottle (10). In order to activate the system of the present invention, firstly the safety band (9) between the medicine bottle (10) and the cap (2) has to be removed.

After the safety band (9) has been removed the, the cap (2) is completely screwed on in a clockwise direction.

With the screwing action, the safety ring (3) is locked onto the inner cap (7). After locking, the electric copper (4) switch positioned below the security ring (3) and the electric copper switch (8) on the inner cap (7) are connected.

The system, which is now functional, warns the user with light and sound at the end of every preset interval, that is to say, when the drug has to be administered.

In order to shut down the active sound and light alerts the electrical flow has to be momentarily shut down. This is achieved by opening the cap (2). At this point, the electric copper (4) switch positioned below the security ring (3) and the electric copper switch (8) on the inner cap (7) are momentarily separated and the sound and light stops.

However, the contact between the electric copper (4) switch positioned below the security ring (3) and the electric copper switch (8) on the inner cap (7) is cut off for only a moment. As the round rubber stopper (5) expands with the opening of the cap, it is compressed by the inner cap (7). Thus, contact is once again established between the electric copper (4) switch positioned below the security ring (3) and the electric copper switch (8) on the inner cap (7). The electrical flow is thus reactivated. Due to the round rubber stopper (5) the system is able to continue its function even when the cap (2) is not screwed onto the medicine bottler (10). Therefore, the time interval before the next drug administration continues uninterrupted and the integrated sound and light circuit having a timer (6) is allowed to issue the necessary alert on time.

As the cap (2) is screwed onto the medicine bottle (10) once again, the round rubber stopper (5) is again compressed and the system continues the time count until the next alert as the electric copper (4) switch positioned below the security ring (3) and the electric copper switch (8) on the inner cap (7) are once again connected.

The invention claimed is:

1. A warning system providing a reminder through a sound and light alert repetitively at certain intervals, characterized in that it comprises; a translucent plastic, produced especially to convey light, a cap, safety ring, an electric copper switch positioned at the lower part of the safety ring, a round rubber stopper positioned around the safety ring, an integrated sound and light circuit having a timer, an inner cap, an electric copper switch positioned on the inner cap, a safety band, and a medicine bottle.

2. The warning system of claim 1, wherein after the removal of the safety band the cap is screwed on in a clockwise direction and the safety band is secured to the inner cap, and from the locking instance on, the electric copper switch positioned below the security ring and the electric copper switch on the inner cap are connected to activate the system to provide the preset sound and light alerts at repeated instances.

3. The warning system of claim 2 wherein the integrated sound and light circuit having a timer is adjustable to provide the sound and light alerts in accordance with the type and amount of drugs contained in the bottle with which it is used, and is further able to provide the necessary power to keep the system functioning.

4. The warning system of claim 3 wherein the round rubber stopper positioned around the safety ring is expanded when the cap is unscrewed and thus establishes contact between the electric copper switch positioned below the security ring and the electric copper switch on the inner cap, thereby allowing the system to function without pause.

5. The warning system of claim 3 wherein the specially produced translucent plastic provides increased projection of light by increasing its emission during the light alert.

6. The warning system of claim 2 wherein the round rubber stopper positioned around the safety ring is expanded when the cap is unscrewed and thus establishes contact between the electric copper switch positioned below the security ring and the electric copper switch on the inner cap, thereby allowing the system to function without pause.

7. The warning system of claim 2 wherein the specially produced translucent plastic provides increased projection of light by increasing its emission during the light alert.

8. The warning system of claim 1 wherein, the integrated sound and light circuit having a timer is adjustable to provide the sound and light alerts in accordance with the type and amount of drugs contained in the bottle with which it is used, and is further able to provide the necessary power to keep the system functioning.

9. The warning system of claim 8 wherein the round rubber stopper positioned around the safety ring is expanded when the cap is unscrewed and thus establishes contact between the electric copper switch positioned below the security ring and the electric copper switch on the inner cap, thereby allowing the system to function without pause.

10. The warning system of claim 8 wherein the specially produced translucent plastic provides increased projection of light by increasing its emission during the light alert.

11. The warning system of claim 1 the round rubber stopper positioned around the safety ring is expanded when the cap is unscrewed and thus establishes contact between the electric copper switch positioned below the security ring and the electric copper switch on the inner cap, thereby allowing the system to function without pause.

12. The warning system of claim 1 wherein characterized in that; the specially produced translucent plastic provides increased projection of light by increasing its emission during the light alert.

* * * * *